US012012877B2

(12) United States Patent
Kujak et al.

(10) Patent No.: US 12,012,877 B2
(45) Date of Patent: Jun. 18, 2024

(54) SYSTEMS AND METHODS FOR BACKLASH COMPENSATION IN CAM PHASING SYSTEMS

(71) Applicant: HUSCO Automotive Holdings LLC, Waukesha, WI (US)

(72) Inventors: Michael Kujak, Hartland, WI (US); Todd Wollenberg, Milwaukee, WI (US); Patrick Heithoff, Sussex, WI (US)

(73) Assignee: HUSCO Automotive Holdings LLC, Waukesha, WI (US)

( * ) Notice: Subject to any disclaimer, the term of this patent is extended or adjusted under 35 U.S.C. 154(b) by 0 days.

(21) Appl. No.: 18/104,476

(22) Filed: Feb. 1, 2023

(65) Prior Publication Data

US 2023/0243281 A1 Aug. 3, 2023

Related U.S. Application Data

(60) Provisional application No. 63/305,947, filed on Feb. 2, 2022.

(51) Int. Cl.
*F01L 1/344* (2006.01)

(52) U.S. Cl.
CPC ..... *F01L 1/3442* (2013.01); *F01L 2800/00* (2013.01); *F01L 2810/00* (2013.01)

(58) Field of Classification Search
CPC . F01L 1/3442; F01L 2800/00; F01L 2810/00; F01L 2001/34483; F01L 1/34403; F01L 1/352; F01L 2201/00; F01L 2820/03; F01L 2820/031; F01L 2820/032; F01L 2820/033; F02D 13/0219
USPC ..... 123/90.15
See application file for complete search history.

(56) References Cited

U.S. PATENT DOCUMENTS

| | | | | |
|---|---|---|---|---|
| 5,119,691 | A | 6/1992 | Lichti et al. | |
| 6,571,757 | B1 * | 6/2003 | Simpson | F01L 1/34 123/90.31 |
| 10,072,537 | B2 | 9/2018 | Schmitt et al. | |
| 2003/0131812 | A1 | 7/2003 | Hosoya | |
| 2003/0196617 | A1 * | 10/2003 | Simpson | F01L 1/022 123/90.15 |
| 2003/0230262 | A1 * | 12/2003 | Quinn, Jr. | F01L 1/344 123/90.15 |
| 2004/0003788 | A1 * | 1/2004 | Taylor | F01L 1/3442 123/90.15 |

(Continued)

FOREIGN PATENT DOCUMENTS

| | | | | |
|---|---|---|---|---|
| DE | 202014003887 U1 * | 9/2015 | | F02D 11/10 |
| DE | 102012209910 B4 * | 7/2021 | | F01L 1/3442 |

OTHER PUBLICATIONS

Translation DE-102012209910-B4 (Year: 2024).*

(Continued)

*Primary Examiner* — J. Todd Newton
(74) *Attorney, Agent, or Firm* — Quarles & Brady LLP

(57) ABSTRACT

The present disclosure provides systems and methods to compensate for backlash within a cam phasing system. For example, compensating for backlash by commanding a predetermined amount of additional actuator movement to account for backlash within a cam phaser. According to some aspects, a spring is provided within a cam phaser to unidirectionally take up the backlash within the cam phasing system.

15 Claims, 10 Drawing Sheets

(56) References Cited

U.S. PATENT DOCUMENTS

| | | | | |
|---|---|---|---|---|
| 2009/0198437 | A1* | 8/2009 | Mladenovic | F01L 1/26 464/1 |
| 2016/0186618 | A1* | 6/2016 | Simpson | F01L 1/047 123/90.1 |
| 2016/0327124 | A1 | 11/2016 | McCloy et al. | |
| 2018/0073598 | A1 | 3/2018 | Pluta et al. | |
| 2022/0195898 | A1 | 6/2022 | Van Weelden et al. | |

OTHER PUBLICATIONS

Translation DE-202014003887-U1 (Year: 2024).*
European Patent Office, Extended European Search Report, Application No. 23154211.9, dated Jun. 16, 2023, 8 pages.

* cited by examiner

SYSTEMS AND METHODS FOR BACKLASH COMPENSATION IN CAM PHASING SYSTEMS

CROSS-REFERENCES TO RELATED APPLICATIONS

This application claims the benefit of U.S. Provisional Application No. 63/305,947, filed Feb. 2, 2022, which is herein incorporated by reference in its entirety.

STATEMENT REGARDING FEDERALLY SPONSORED RESEARCH

Not Applicable.

BACKGROUND

In general, cam phasing systems can include a drive member (e.g., a sprocket) coupled to a crankshaft and a driven member (e.g., a rotor) coupled to a camshaft and rotationally driven by the drive member.

BRIEF SUMMARY

In one aspect, the present disclosure provides a method of controlling a cam phasing system for varying a rotational relationship between a crank shaft and a cam shaft. The cam phasing system can include a cam phaser having a sprocket hub configured to be driven by a crankshaft, a cradle rotor configured to be coupled to a camshaft, a spider rotor arranged between the cradle rotor and the sprocket hub, and an actuator configured to adjust a phase angle of the cradle rotor relative to the sprocket hub. The method can include receiving a phase angle command to actuate a cam phaser from a first phaser position to a second phaser position, in which the first phaser position and the second phaser position corresponds to a first phase angle and a second phase angle, respectively. The method can further include determining a required actuator position of the actuator that corresponds to the second phaser position, commanding the actuator from a current actuator position to the required actuator position plus a predetermined amount of actuator overshoot. The predetermined amount of actuator overshoot can be configured to compensate for backlash within the cam phasing system.

According to another aspect, the present disclosure provides a cam phasing system for varying a rotational relationship between a crank shaft and a cam shaft. The cam phasing system can include a sprocket hub configured to be driven by a crankshaft, a cradle rotor configured to be coupled to a camshaft, a spider rotor arranged between the sprocket hub and the cradle rotor. The spider rotor can be configured to selectively lock and unlock relative rotation between the sprocket hub and the cradle rotor. The cam phasing system can further include at least one spring coupled between the spider rotor and the cradle rotor. The spring can be configured to bias the cradle rotor relative to the spider rotor in a first rotational direction to compensate for backlash within the cam phasing system.

According to another aspect, the present disclosure provides a method of controlling a cam phasing system. The method can include actuating an actuator from a first position to a second position in response to a command from a controller. The method can further include rotating a follower member from a first rotational position to a second rotational position in response to movement of the actuator.

The magnitude of actuation of the actuator can correspond to a magnitude of rotation of the follower member. The follower member can be biased in the first rotational direction relative to a cradle rotor. Rotating the follower member in the first rotational direction includes rotating the follower member a first rotational distance between the first rotational position and the second rotational position, and a second rotational distance corresponding to an amount of backlash in the cam phasing system.

The foregoing and other aspects and advantages of the disclosure will appear from the following description. In the description, reference is made to the accompanying drawings which form a part hereof, and in which there is shown by way of illustration a preferred configuration of the disclosure. Such configuration does not necessarily represent the full scope of the disclosure, however, and reference is made therefore to the claims and herein for interpreting the scope of the disclosure.

BRIEF DESCRIPTION OF DRAWINGS

The invention will be better understood and features, aspects, and advantages other than those set forth above will become apparent when consideration is given to the following detailed description thereof. Such detailed description makes reference to the following drawings.

DETAILED DESCRIPTION

Figure 1:
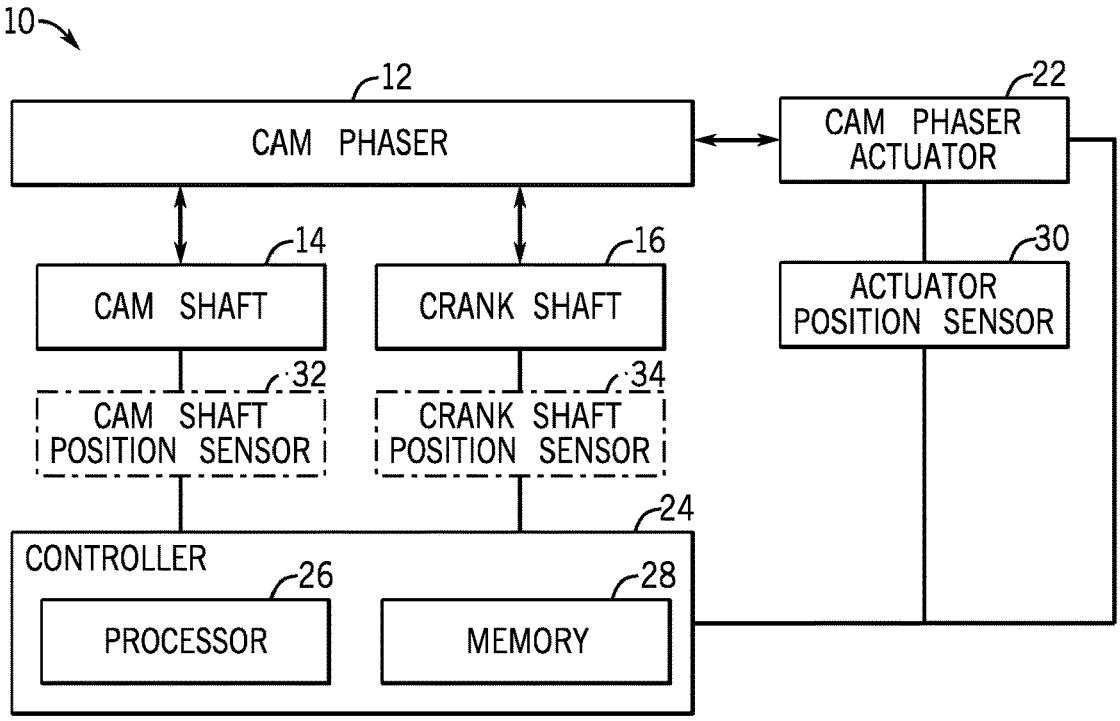
FIG. 1 is a schematic illustration of a cam phasing control system according to one aspect of the present disclosure.

The following discussion is presented to enable a person skilled in the art to make and use embodiments of the invention. Various modifications of the illustrated embodiments will be readily apparent to those skilled in the art, and the generic principles herein can be applied to other embodiments and applications without departing from embodiments of the invention. Thus, embodiments of the invention are not intended to be limited to embodiments shown but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, and unless otherwise indicated, the terms "near," "about," and "approximately" refer to a range of values±5% of the numeric value that the term precede As used herein, the term "axial" and variations thereof refers to a direction that extends generally along an axis of symmetry, a central axis, or an elongate direction of a particular component or system. For example, axially extending features of a component may be features that extend generally along a direction that is parallel to an axis of symmetry or an elongate direction of that component. Similarly, the use herein of the term "radial" and variations thereof refers to directions that are generally perpendicular to a corresponding axial direction. For example, a radially extending structure of a component may generally extend at least partly along a direction that is perpendicular to a longitudinal or central axis of that component. The use herein of the term "circumferential" and variations thereof refers to a direction that extends generally around a circumference of an object or around an axis of symmetry, a central axis or an elongate direction of a particular component or system.

Cam phasing systems may include play and/or backlash between components of the cam phasing system. The backlash may be caused by tolerance and/or fitments between components of the cam phasing system. In one non-limiting example, backlash prevents movement of a drive member from generating corresponding movement in a driven member. This backlash can be accounted for when adjusting the drive/driven member in order to more accurately position the drive and/or driven member. In one example, a camshaft can include backlash, for example, a camshaft with a split camshaft design having a coupling between camshaft portions (e.g., a Lovejoy coupling, an Oldham coupling, etc.) may include backlash. According to other examples, gear trains or chain and sprocket systems within a cam phasing system, or in connection with a cam phasing system, can also include backlash. The backlash present within a cam phasing system can, in some cases, potentially lead to inaccuracies in control of the cam phasing system during phasing operations. For example, in some cases, backlash within the cam phasing system can cause over- and/or under-positioning (i.e., overshoot and/or undershoot) when trying to target a desired phase angle. The systems and methods described herein provide a cam phasing system and control method that can compensate (e.g., selectively compensate based on one or more factors) for backlash within cam phasing systems to provide more accurate control of the cam phasing system.

FIG. 1 shows an example of a cam phasing system 10 configured to control a phase angle of a camshaft 14 relative to a crankshaft 16. The cam phasing system 10 can include a cam phaser 12 coupled between the camshaft 14 and the crankshaft 16 of an internal combustion engine. The cam phasing system 10 can include a cam phaser actuator 22 configured to selectively engage the cam phaser 12. In one non-limiting example, the actuator 22 is configured to adjust the phase angle of the camshaft 14 via modifying a rotational position of the camshaft 14 relative to the crankshaft 16.

The actuator 22 can be configured to provide an axial and/or a rotational input to the cam phaser 12. In some non-limiting examples, the actuator 22 can be a linear actuator and/or solenoid configured to axially displace in response to an electrical current. In some non-limiting examples, the actuator 22 can also be a mechanical linkage, a hydraulic actuation element, and/or any viable mechanism for providing an axial force and/or displacement to the cam phaser 12. According to another non-limiting example, the actuator 22 can be a rotary actuator configured to apply a torque to the cam phaser 12, for example, an electric motor, reverse rack and pinion, worm-screw, and/or other suitable rotary actuator. In one non-limiting example, the rotary actuator may include a stator and a rotor electromagnetically coupled to the stator. In one form, a current may be applied to the rotary actuator to generate a rotary output configured to rotate the rotary actuator in a desired direction at a desired torque. In some non-limiting examples, the rotary actuator may be a brushless DC (BLDC) motor.

The cam phasing system 10 can include a controller 24 including a processor 26 and a memory 28. The memory 28 can be a non-transitory computer readable medium and/or other form of memory, such as flash memory, random access memory (RAM), read-only memory (ROM), and/or other types of memory, containing programs, software, and/or instructions executable by the processor 26. According to some non-limiting examples, the controller 24 can be integrated into the engine control unit (ECU) of the engine. In other non-limiting examples, the controller 24 can be separate from the ECU, but in electrical communication with the ECU. For example, the controller 24 can receive commands from the ECU execute instructions based on those commands and provide feedback to the ECU. According to some examples, the controller 24 can be integrated into a body of the actuator 22, such that the controller 24 and actuator 22 form a single unitary component.

In the illustrated non-limiting example, the controller 24 can be in electrical communication with the actuator 22 to supply commands to the actuator 22. The controller 24 can also be in electrical communication with an actuator position sensor 30 configured to measure/sense a position of the actuator 22. According to some non-limiting examples, the controller 24 can also be in electrical communication with a camshaft position sensor 32 and a crankshaft position sensor 34 configured to detect the rotational position of the camshaft 14 and the crankshaft 16, respectively. The controller 24 can receive the signals from the camshaft and crankshaft position sensors 32, 34 to calculate a phase angle of the camshaft 14 relative to the crankshaft 16. In some cases, the camshaft and crankshaft speeds and accelerations can also be derived from the camshaft position sensor 32 and the crankshaft position sensor 34. Thus, the controller 24 may monitor the position of the actuator, the position of the camshaft, and/or the position of the crankshaft simultaneously. Based on the position of the actuator, camshaft, and/or crankshaft, the controller may command the actuator to change position, such that the relative position of the camshaft with respect to the crankshaft is modified.

Figure 2:
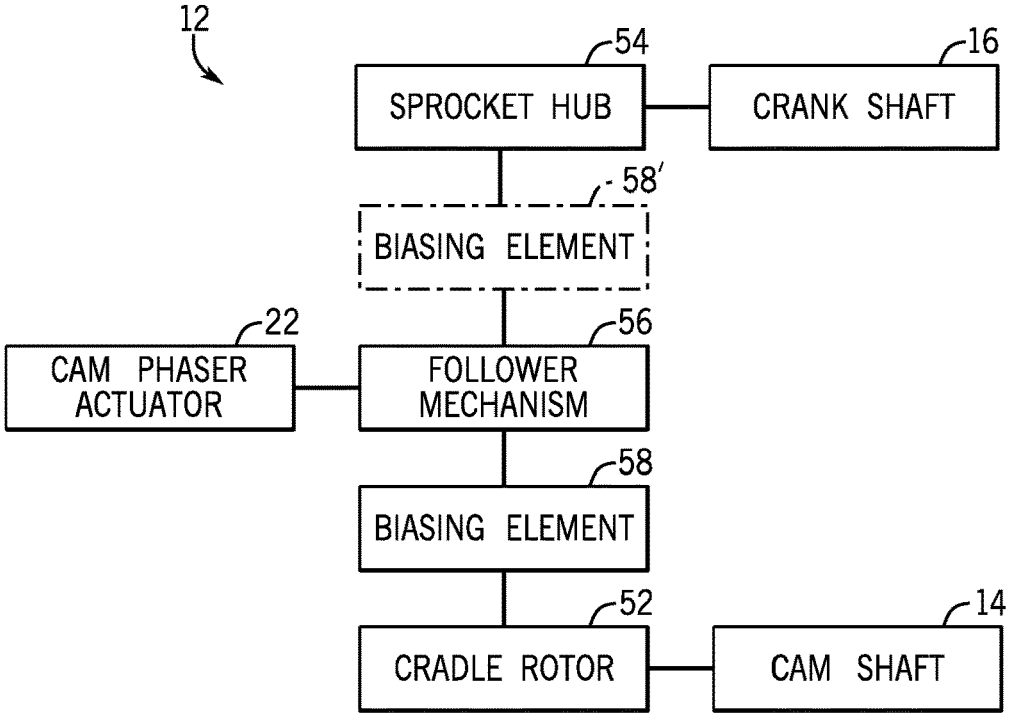
FIG. 2 is a schematic illustration of a cam phaser that can be used in conjunction with the cam phasing control system of FIG. 1.

Referring to FIGS. 1 and 2, the cam phaser 12 includes a cradle rotor 52 coupled to the camshaft 14 and a sprocket hub 54 driven by the crankshaft 16. In one non-limiting example, the cradle rotor 52 is coupled to the camshaft 14 so that rotation of the cradle rotor 52 imparts corresponding rotation to the camshaft 14. The sprocket hub 54 may be driven by the crankshaft 16 such that actuation of the crankshaft 16 generates rotation of the sprocket hub 54. The sprocket hub 54 and crankshaft 16 may be connected via a belt and/or pulley system, a chain and sprocket system, and/or a gear train assembly. The sprocket hub 54 is driven at a speed proportional to a speed of the crankshaft 16 (e.g., half the speed of the crankshaft 16). Alternative configurations for the relative coupling of the cradle rotor 52, the sprocket hub 54, the camshaft 14, and the crankshaft 16 are also possible. For example, according to some non-limiting examples, the crankshaft can be coupled to the cradle rotor and the camshaft can be coupled to the sprocket hub.

In the illustrated non-limiting example, the cam phaser 12 further includes a follower mechanism 56 arranged between the sprocket hub 54 and the cradle rotor 52. The follower mechanism 56 can be configured to selectively lock and unlock relative rotation between the sprocket hub 54 and the cradle rotor 52. As illustrated in FIG. 2, the actuator 22 can be configured to directly and/or indirectly engage the follower mechanism 56. In some non-limiting examples, the follower mechanism 56 is in the form of a bearing case. In some non-limiting examples, the follower mechanism 56 can be configured as a spider rotor. The follower mechanism 56 can be coupled to the cradle rotor 52 so that rotation of the follower mechanism 56 causes corresponding rotation of the cradle rotor 52, and thereby rotation of the camshaft 14. Put differently, the follower mechanism 56 may alter a rotational relationship between the cradle rotor 52 and the sprocket hub 54, thereby altering a rotational relationship between the camshaft 14 and the crankshaft 16.

In the illustrated non-limiting example, the cam phaser 12 includes at least one biasing element 58 arranged between the follower mechanism 56 and the cradle rotor 52. The biasing element 58 can (rotationally) bias the cradle rotor 52 relative to the follower mechanism 56 such that a constant idle position of the cradle rotor 52 is maintained. To aid in compensating for backlash, the biasing element can unidirectionally bias the cradle rotor 52 relative to the follower mechanism 56 in a first rotational direction, which generates a torque between the camshaft 14 and the follower mechanism 56. According to other non-limiting examples, a biasing element 58' can be alternatively and/or additionally arranged between the sprocket hub 54 and the follower mechanism 56. According to some non-limiting examples, the biasing element 58 can be configured as a spring, for example, a coil spring, or it can be configured as another type of resilient member, for example, a rubber damper. According to other non-limiting examples, the biasing element 58 can be configured as a torsional spring.

The (unidirectional) torque provided by the biasing element 58 biases (e.g., takes up) the backlash in the cam phasing system 10 to a particular (e.g., predetermined) position and/or location in the cam phasing system so that the backlash can be accurately accounted for. For example, actuating the cam phaser 12 in a direction opposing the biased direction (e.g., a second rotational direction) alleviates the effect of backlash on the system when moving opposite the biased direction (e.g., as if there were no backlash present in the system). In contrast, when the cam phaser 12 is actuated in the biased direction (e.g., the first rotational direction), all of the backlash in the cam phasing system 10 is present during actuation. Since rotation in the first rotational direction results in all of the backlash and rotation in the second rotational direction results in no backlash, and the overall amount of backlash in the system is known (e.g., via measured and/or calculated pre and/or post manufacture), control strategies can be implemented to account for the backlash in the system in order to accurately adjust phase angle of the camshaft.

Figure 3:
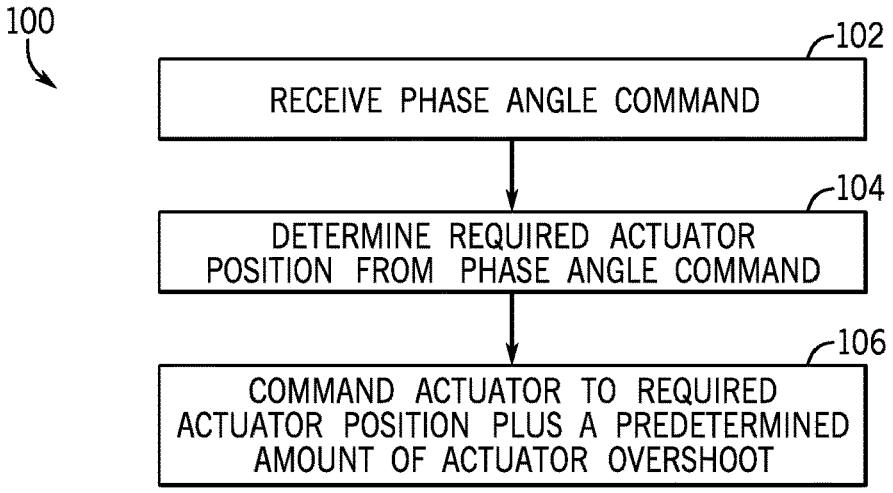
FIG. 3 illustrates a method of controlling the cam phaser of FIG. 2 to compensate for backlash within a cam phasing system.
Figure 4:
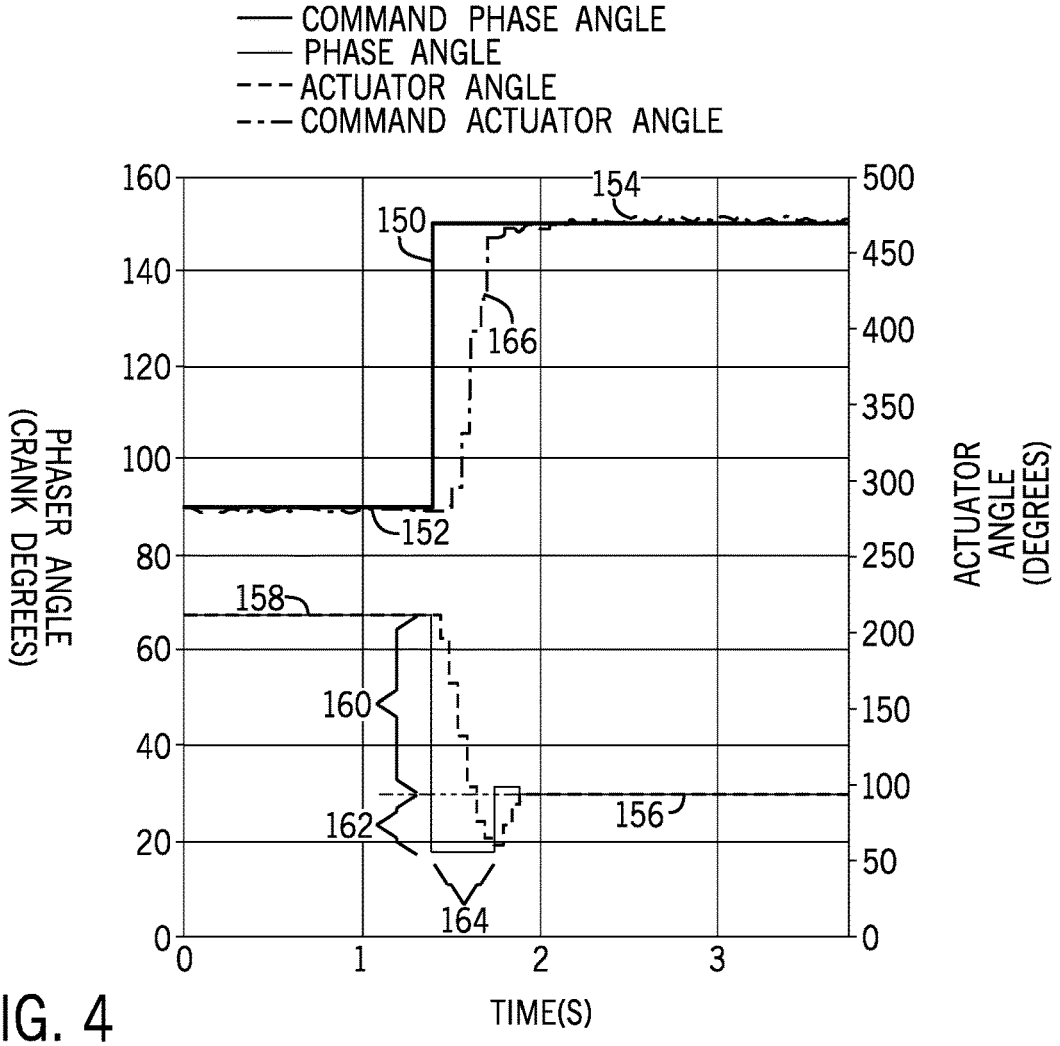
FIG. 4 is a graph illustrating a change in phase angle and actuator position during execution of the method of FIG. 3.

FIGS. 3 and 4 illustrate a method 100 of controlling the cam phasing system 10 to compensate for backlash within the system. For example, to compensate for the effects of backlash during actuation of the cam phaser 12. At stage 102 the controller 24 can receive a phase angle command 150. The phase angle command 150 may command the actuator to move the cam phaser 12 from a first phaser position to a second phaser position. For example, the controller 24 can receive the phase angle command 150 from the ECU and, in response, generate an appropriate command to output to the actuator 22. In the non-limiting example illustrated in FIG. 4, the first phaser position corresponds to a first phase angle 152 and the second phaser position corresponds to a second phase angle 154.

At stage 104, the controller 24 can determine a required actuator position 156 based on the phase angle command 150. In one non-limiting example, the required actuator position 156 may correspond to the second phaser position. As should be appreciated, the actuator position has a corresponding relationship to a phase angle of the cam system. For example, each angular and/or axial position of the actuator may correspond to a phase angle of the cam system. As a result, the controller 24 can determine the actuator position based on the current phase angle and/or determine the current phase angle from the current actuator position. These corresponding values may be stored within the memory 28 of the controller such that movement of the actuator to a known position corresponds to a known change in the phase angle. According to some non-limiting examples, the cam phaser 12 can define a proportional relationship between a magnitude of rotation or axial displacement (i.e., displacement position) of the actuator 22 (e.g., an output shaft of the actuator 22) and a magnitude of the relative rotation between the cradle rotor 52 and the sprocket hub 54.

The controller 24 may command the actuator 22 from a current actuator position 158 to the determined required actuator position. In some non-limiting examples, the controller 24 may command the actuator 22 to move an additional predetermined magnitude, which corresponds to an amount equal to backlash within the system. As should be appreciated, the amount of backlash within the system may be precalculated during and/or after manufacture of the system, such that the amount of backlash may be saved to the memory 28 of the controller 24. Thus, the controller 24 may command the actuator 22 to move an amount equal to the amount of backlash, which mitigates the risk of improper positioning of the cam phasing system The command from the controller 24 may include a single command and/or may include multiple command portions, such as a first portion 160 and a second portion 162. The first portion 160 can correspond to moving the actuator 22 a magnitude corresponding to actuation from the current actuator position 158 to the required actuator position (e.g., as if there were no backlash). The second portion 162 may correspond to moving the actuator 22 an additional amount corresponding to the amount of backlash within the system.

According to the illustrated non-limiting example, the controller 24 can command the actuator 22 from the current actuator position 158 to the required actuator position 156 in addition to the predetermined magnitude of actuator overshoot. For example, the first portion 160 may correspond to movement from the current actuator position to the required actuator position, while the second portion 162 may correspond to movement corresponding to a predetermined amount of overshoot. The overshoot command (i.e., the second portion 162) may last for a period of time 164 until the actuator approached the overshoot commanded positioned (e.g., the actuator moves the amount indicated as the overshoot amount). After and/or before that period of time, the controller 24 can then command the actuator 22 to the required actuator position 156. Thus, the overshoot command is only active until the actuator approaches and/or moves an amount equal to the amount of backlash present in the system.

Figure 5:
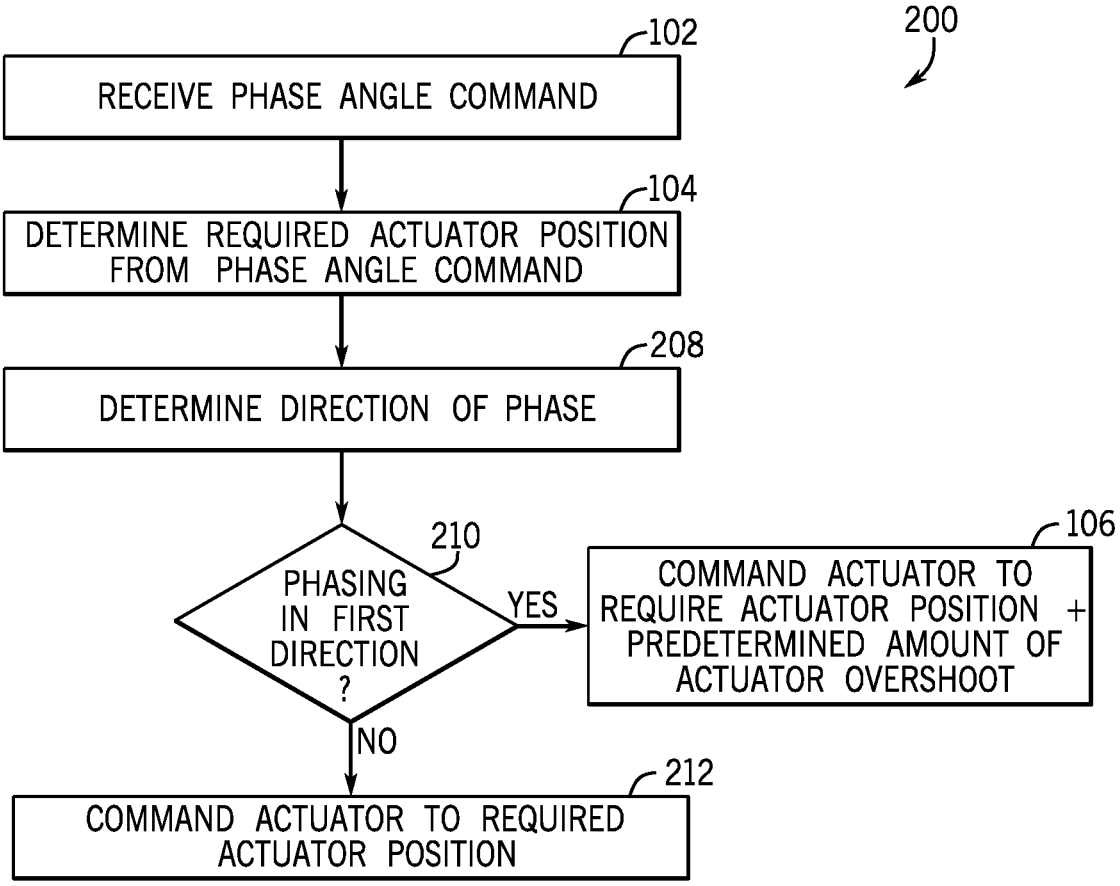
FIG. 5 illustrates a method of controlling the cam phaser of FIG. 2 to compensate for backlash within the cam phasing system based on a rotational direction of the cam phaser.

As described herein, the biasing element 58 can apply a unidirectional torque and/or biasing force, which biases the cam phasing system 10 such that all of the backlash is arrange in a single rotational direction (e.g., the first rotational direction). FIG. 5 illustrates a method 200 of controlling the cam phasing system 10 such that the backlash within the system is biased in a single rotational direction. As discussed above, at stage 102, the controller 24 can receive a phase angle command 150 to actuate the cam phaser 12 from a first phaser position to a second phaser position. The controller 24 may then determine a required actuator position 156 corresponding to the second phaser position at stage 104 (e.g., via one or more predetermined reference values saved in the memory 28).

Figure 6:
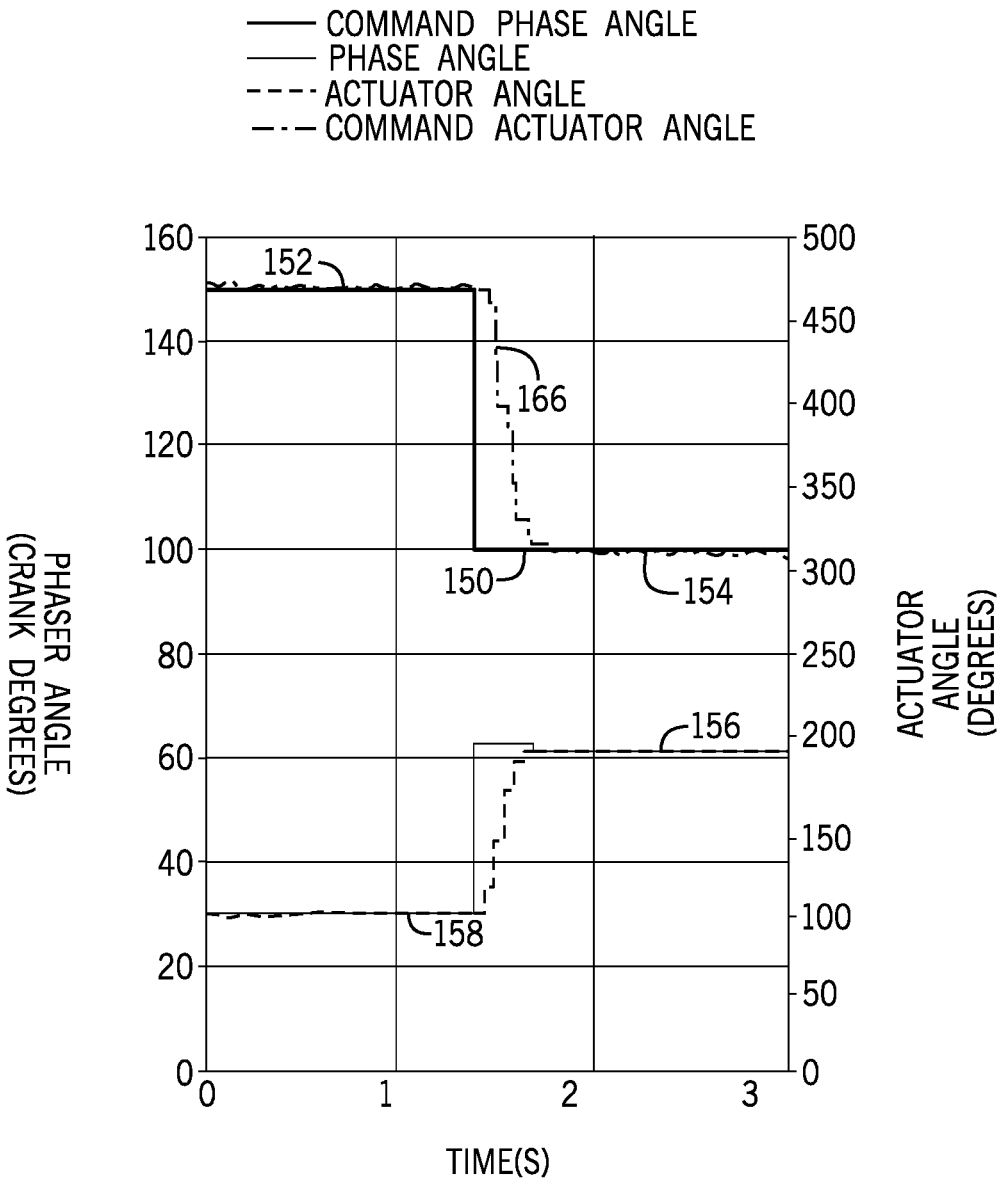
FIG. 6 is a graph illustrating a change in phase angle and actuator position during execution of the method of FIG. 5.

Referring to FIGS. 4-6, at stage 208, the controller 24 can determine if the phase angle command requires a change in phase angle in the biased direction (e.g., actuation of the cradle rotor 52 in the first rotational direction) or the direction opposite the biased direction (e.g., actuation of the cradle rotor 52 in the second rotational direction). At stage 210, the controller 24 can determine if the commanded rotation and/or a phase angle change requires actuation in the direction opposing the biased direction (e.g., the second rotational direction). If the controller 24 determines the command requires actuation opposite the biased direction, the controller 24 can command the actuator 22 from a current actuator position 158 to the required actuator position 156 at stage 212 without additional actuator movement corresponding to backlash within the system. Put differently, when moving in a direction opposing the biased direction, the biasing member will have taken up the backlash in the system so that movement of the actuator 22 does not account for additional backlash in the system. According to some non-limiting examples, a trace amount of additional actuator movement may still occur due to elasticity of the cam phasing system 10.

If the controller 24 determines that the phase angle command requires a phase angle change (i.e., movement) in the biased direction (e.g., the first rotational direction) at stage 210, the controller 24 can command the actuator 22 from a current actuator position 158 to the required actuator position 156 plus a predetermined magnitude of backlash in the system at stage 106. Thus, when the cam phaser 12 is actuated in the direction that opposes the biased direction, no and/or minimal backlash is present during actuation. In contrast, when the cam phaser 12 is actuated in the biased direction, all of the backlash in the cam phasing system 10 is present during actuation. As a result, the backlash can be accounted for and compensated for by the controller during actuation of the actuator to mitigate errors in actuator position, which may lead to errors in cam phasing.

In the non-limiting example described above, the first rotational direction (e.g., biased direction) can correspond to a retard direction of the camshaft during cam phasing and the second rotational direction (e.g., opposite of biased direction) can correspond to an advanced direction of the camshaft during cam phasing. For example, in the non-limiting example above, the backlash need only be compensated for when actuating the cam phaser 12 in the retard direction. In other non-limiting examples, the biased direction may correspond to the advanced direction of the camshaft during cam phasing and unbiased direction may correspond to the retard direction of the cam during camshaft phasing.

Figure 7:
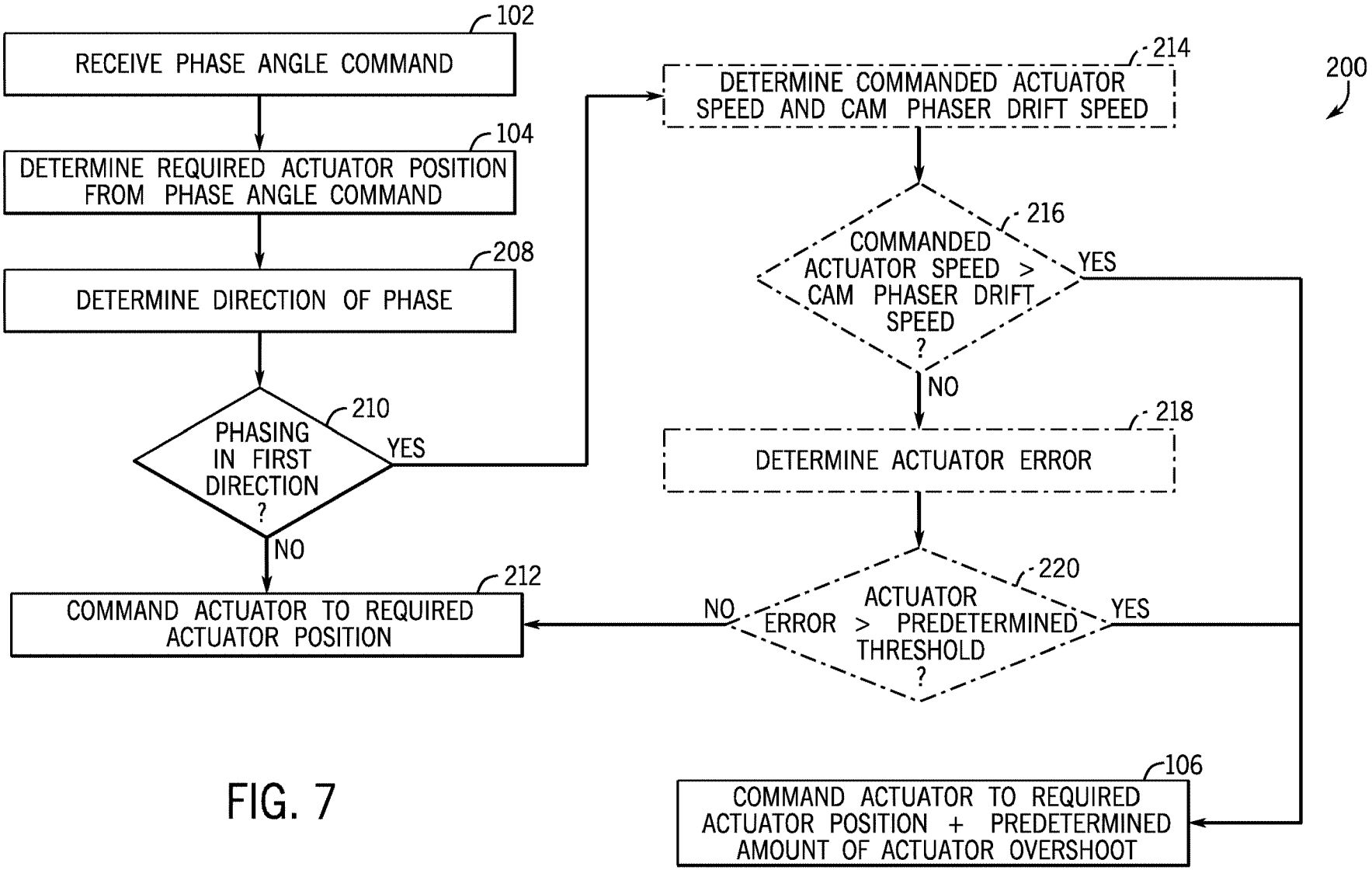
FIG. 7 illustrates the method of controlling the cam phaser of FIG. 5 with additional, optional, steps.

FIG. 7 illustrates the method 200 of FIG. 5, including additional optional processes to control the cam phasing system 10. Similar to the method of FIG. 5, the controller 24 can receive a phase angle command 150 at stage 102. The controller then commands the actuator to actuate the cam phaser 12 from a first phaser position to a second phaser position, then the controller 24 can determine a required actuator position 156 that corresponds to the second phaser position at stage 104.

Figure 8:
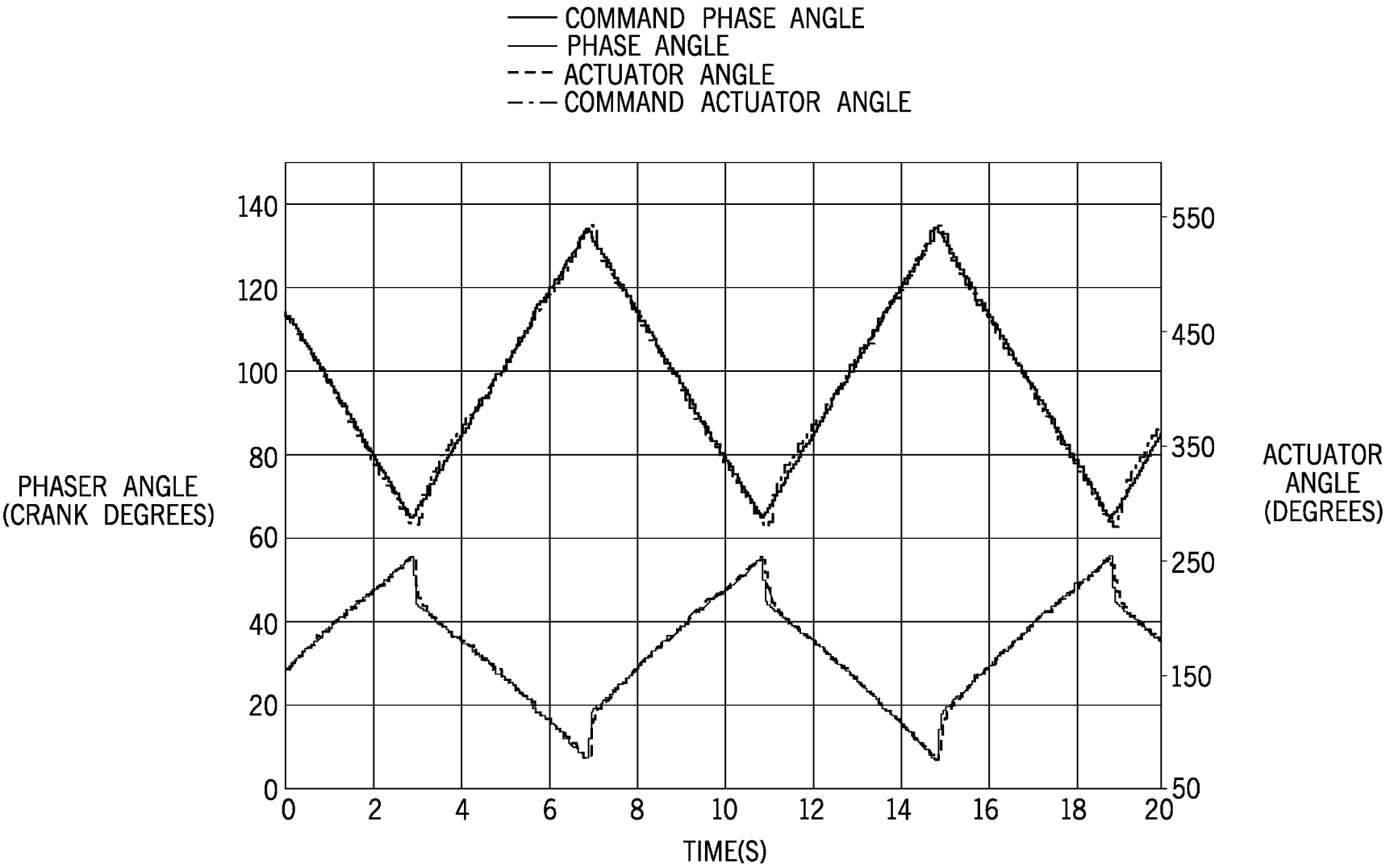
FIG. 8 illustrates a graph depicting a change in phase angle and actuator position over time during execution of the method of FIG. 7.

Referring now to FIG. 7, in some non-limiting examples, if the controller 24 determines that the phase angle command requires a movement (e.g., a phase angle change) in the biased direction (e.g., the first rotational direction) at stage 210, then the controller 24 can proceed to stage 214. At stage 214, the controller 24 can determine a commanded actuator speed and/or a cam phaser drift speed. The commanded actuator speed can be based on a derivative of the commanded position. For example, the commanded actuator speed can be defined by the current actuator position minus the previous actuator position divided by the period of time that lapsed between the current command and the previous actuator command. The cam phaser drift speed can be based on the speed of the phase change (e.g., movement) of the cam phaser 12, which can be dependent on engine factors (such as engine speed) and the applied torque from the biasing element 58. Put differently, the biasing element 58 applies a biasing force to move the follower mechanism 56 and the cradle rotor 52 relative to one another at a cam phaser drift speed of the cam phaser. At stage 216, if the controller 24 determines that the commanded actuator speed is greater than the cam phaser drift speed, then the controller 24 can command the actuator 22 from a current actuator position 158 to the required actuator position 156 in addition to a predetermined magnitude of actuator overshoot, as illustrated in FIG. 4 and previously described above. According to some examples, the commanded actuator speed can greater than the cam phaser drift speed during fast ramp commands (see, e.g., FIG. 8).

With continued reference to FIG. 7, if the controller 24 determines that the commanded actuator speed is not greater than the cam phaser drift speed, then the controller 24 can proceed to block 218 to determine an actuator positioning error. The actuator positioning error can be defined as the difference between the current actuator position (e.g., line 158 in FIG. 4) and the commanded or required actuator position (e.g., line 156 in FIG. 4). Put differently, the actuator positioning error is the difference between the current actuator position and the intended actuator position, such that actuator positioning error describes the difference between the current and commanded position of the actuator. For example, a large actuator error can be incurred during a step response. According to another example, a small actuator error can be incurred during a slow ramp. In one non-limiting example, a large actuator error may be greater than five (5) degrees and a small actuator error may be less than five (5) degrees.

At block 220, if the controller 24 determines that the actuator error is greater than a predetermined threshold, then the controller 24 can proceed to stage 106 and command the actuator 22 from a current actuator position 158 to the required actuator position 156 plus a predetermined amount of additional movement to compensate for backlash within the system. If the controller 24 determines that the actuator error is not greater than the predetermined threshold, then the controller 24 can proceed to stage 212 and command the actuator 22 from a current actuator position 158 to the required actuator position 156 without providing additional movement to compensate for backlash within the system. According to some non-limiting examples, the predetermined error threshold can be between 0 and 50 degrees.

Cam Phaser Examples

Figure 9:
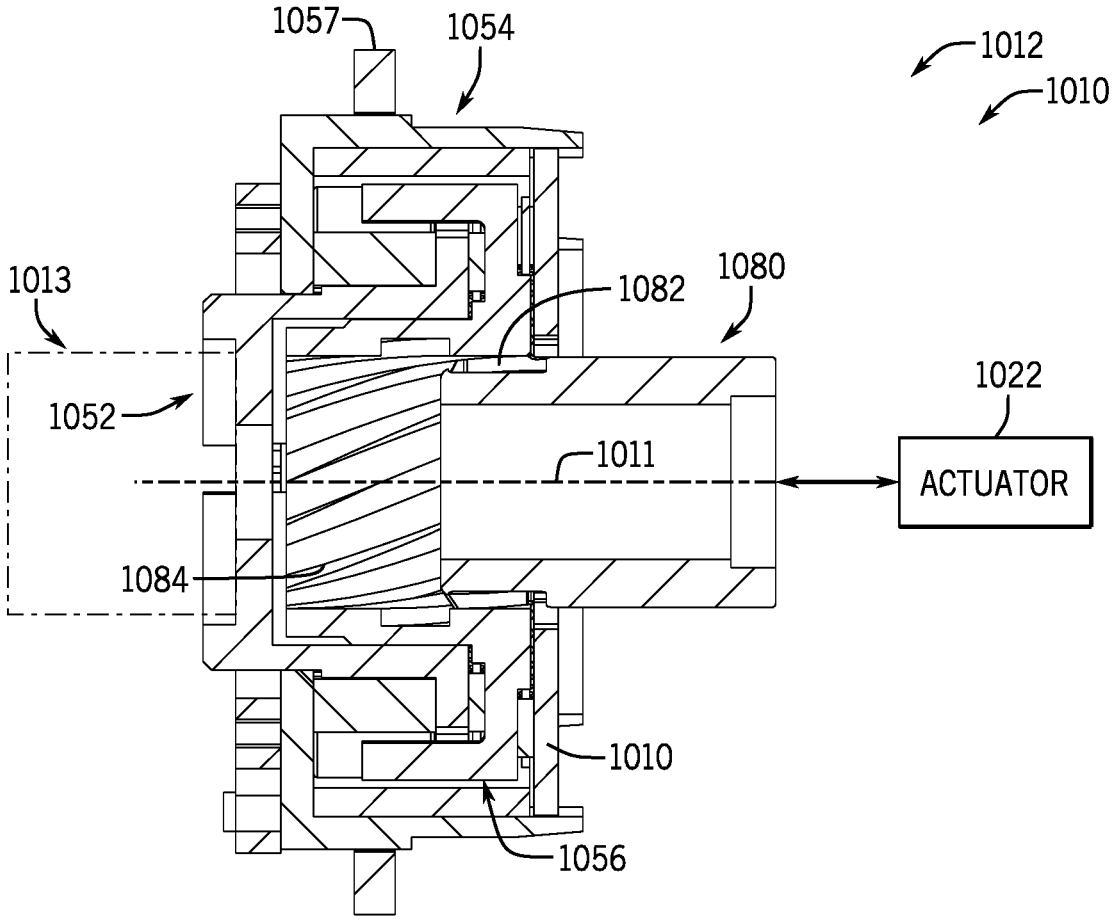
FIG. 9 illustrates a non-limiting example of a cam phasing system for use with the control system of FIG. 1 with an axial displacement actuator.
Figure 10:
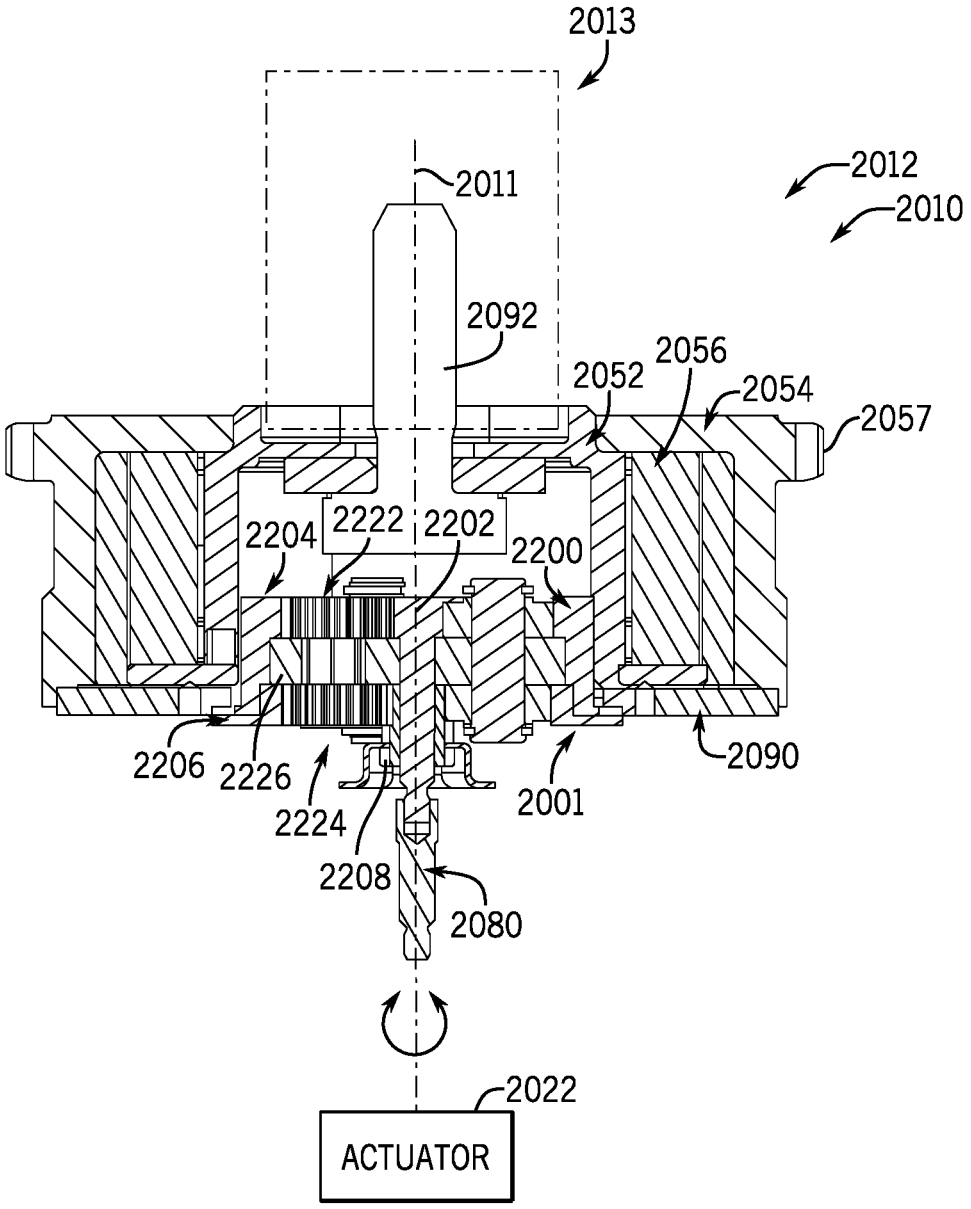
FIG. 10 illustrates a non-limiting example of a cam phasing system for use with the control system of FIG. 1 with a rotational displacement actuator.

FIGS. 9 and 10 illustrate non-limiting examples of a cam phaser that can include a biasing element configured to compensate for backlash within a cam phasing system consistent with the above description. As previously described, actuators can be linear actuators, which can axially displace an output shaft. Alternatively or additionally, actuators may be rotary actuators, which can rotationally displace an output shaft to actuate the cam phaser. One example of an axial displacement actuator is described in U.S. Pat. No. 10,072,537 to Schmitt et al. entitled "Mechanical Cam Phasing Systems and Methods," the content of which is incorporated herein by reference in its entirety. One example of a rotary actuator is described in United States Patent Application No. 2022/0195898 to Van Weelden et al. entitled "Systems and Methods for Controlled Relative Rotational Motion," the content of which is also incorporated herein by reference in its entirety.

FIG. 9 shows a cam phasing system 1010 coupled to a cam shaft 1013 of an internal combustion engine. As shown in FIG. 9, the cam phasing system 1010 can include a cradle rotor 1052 coupled to a cam shaft, a sprocket hub 1054 coupled to a crank shaft, a spider rotor 1056 (e.g., a follower mechanism) selectively coupled to the cradle rotor 1052, and an input shaft in the form of a helix rod 1080. The sprocket hub 1054, the cradle rotor 1052, the spider rotor 1056, and the helix rod 1080 can each share a common central axis 1011, when assembled. The sprocket hub 1054 can include a sprocket 1057 connected to an outer diameter of the sprocket hub 1054 (or integrally formed therewith). The sprocket 1057 can be coupled to a crank shaft of the internal combustion engine, which can rotate the sprocket hub 1054 at a speed proportional to the speed of the crank shaft.

An actuator 1022 may selectively engage the helix rod 1080 to actuate the helix rod 1080. For example, the actuator 1022 can apply an axial force to the helix rod 1080 in a direction parallel to, or along, the central axis 1011. The actuator 1022 may be a linear actuator, a mechanical linkage, a hydraulically actuated actuation element, and/or any viable mechanism capable of providing an axial force and/or displacement to the helix rod 1080. That is, the actuator 1022 can be configured to axially displace the helix rod 1080 to a known position corresponding to a desired rotational displacement of the spider rotor 1056. The actuator 1022 can be controlled and powered by a controller (e.g., controller 24).

The helix rod 1080 includes a helical portion 1082 configured to engage helical features 1084 of the spider rotor 1056. Interaction between the helical portion 1082 of the helix rod 1080 and the helical features 1084 of the spider rotor 1056 rotates the spider rotor 1056 relative to the sprocket hub 1054. For example, axial displacement of the helix rod 1080 applied by the actuator 1022 rotates the spider rotor 1056. When assembled, as shown in FIG. 9, the spider rotor 1056 can be constrained such that it cannot displace axially. Thus, in response to an axial displacement applied on the helix rod 1080 by the actuator 1022, the spider rotor 1056 rotates clockwise or counterclockwise a known amount (e.g., in a first direction or a second direction). That is, the spider rotor 1056 rotates relative to the sprocket hub 1054 due to the interaction between the helical portion 1082 of the helix rod 1080 and the helical features 1084 of the spider rotor 1056.

To alter a rotational relationship between the cam shaft and the crank shaft a controller (e.g., controller 24 of FIG. 1) commands the actuator 1022 to axially displace the helix rod 1080 from a first position to a second position. When the signal is sent to axially displace the helix rod 1080, the cam phasing system 1010 can transition from a locked state, rotation between the cradle rotor 1052 and the sprocket hub 1054 is locked, to an actuation state, where rotation between the cradle rotor 1052 and the sprocket hub 1054 is unlocked. Displacement of the helix rod 1080 generates reciprocal rotation of the spider rotor 1056, in either clockwise or counterclockwise directions, depending of the direction of the axial displacement. As was mentioned previously, rotation of the spider rotor 1056 can be caused by the interaction between the helical portion 1082 of the helix rod 1080 and the helical features 1084 of the spider rotor 1056.

The spider rotor 1056, in combination with one or more locking assemblies are configured to selectively lock and/or unlock relative rotation between the sprocket hub 1054 and the cradle rotor 1052. For example, rotation of the spider rotor 1056 can cause the spider rotor 1056 to engage locking assemblies arranged between the sprocket hub 1054 and the cradle rotor 1052. Rotation of the spider rotor 1056 unlocks the locking assemblies, which places the cam phasing system 1010 in the actuation state from the locked state. The actuation state enables relative rotation between the cradle rotor and the sprocket hub, whereas the locked state disables relative rotation between the cradle rotor and the sprocket hub. With the cam phasing system 1010 in the actuation state, the cradle rotor 1052 rotationally follows the spider rotor 1056 (e.g., by harvesting cam torque pulses applied to the cradle rotor 1052) in the same direction that the spider rotor 1056 was rotated. The cradle rotor 1052 continues to rotate until the cradle rotor 1052 reaches a rotational position correlating to a magnitude of the axial displacement of the helix rod 1080 and the angle of the helical features 1084. Put differently, a particular axial displacement of the helix rod 1080 is equivalent to a predetermined amount of rotation of the cradle rotor 1052 via the spider rotor 1056.

In general, the design of the cam phasing system 1010 only requires an input force provided to the helix rod 1080 from the actuator 1022 when relative rotation is desired (e.g., the actuator 1022 displaces between fixed positions, and those fixed positions correlate to a known phase angle between the cam shaft and the crank shaft).

FIG. 10 illustrates a non-limiting example of a cam phasing system 2010 including a planetary actuator 2001. In the illustrated non-limiting example, the mechanical cam phasing system 2010 includes a cradle rotor 2052 coupled to a cam shaft, a sprocket hub 2054 coupled to a crank shaft, a bearing cage and/or spider rotor 2056 (e.g., a follow mechanism), a plurality of locking assemblies 2090, and the planetary actuator 2001. In one non-limiting example, the planetary actuator 2001, the sprocket hub 2054, the cradle rotor 2052, and the bearing cage can each share a common central axis 2011, when assembled.

In the illustrated non-limiting example, the mechanical cam phasing system 2010 includes an actuator 2022 in the form of a rotary actuator. In some non-limiting examples, the rotary actuator 2022 may include a stator and a rotor that is electromagnetically coupled to the stator. A current may be applied to the rotary actuator 2022 that may result in a rotational force output being provided by the rotary actuator 2022. In some non-limiting examples, the rotary actuator 2022 may be in the form of a brushless DC (BLDC) motor.

The planetary actuator 2001 includes a first ring gear 2200, a first sun gear 2202, a carrier assembly 2204, a second ring gear 2206, a second sun gear 2208, and an input shaft 2080. The carrier assembly 2204 includes a first set of planet gears 2222, a second set of planet gears 2224, and a carrier plate 2226. The first set of planet gears 2222 and the second set of planet gears 2224 may be arranged on axially opposing sides of the carrier plate 2226. In the illustrated non-limiting example, the first set of planet gears 2222 mesh with the first sun gear 2202 and the second set of planet gears 2224 mesh with the second sun gear 2208.

The first ring gear 2200 may be selectively rotated relative to the second ring gear 2206 in a desired direction. To facilitate rotation of the first ring gear 2200 relative to the second ring gear 2206, the input shaft 2080, which is rotationally coupled to the rotary actuator 2022, may be rotated in a first direction. The rotation of the input shaft 2080 in the first direction results in rotation of the first sun gear 2202 in the first direction. Rotation of the first sun gear 2202 in the first direction results in rotation of the planet gears of the first set of planet gears 2222 in a second direction opposite the first direction, which rotates the first ring gear 2200 in the second direction. With the second sun gear 2208 being rotationally fixed, this selective rotation of the first sun gear 2202, and thereby the first ring gear 2200, allows the first ring gear 2200 to rotate relative to the second ring gear 2206 in the second direction. The opposite is also true if the input shaft is rotated in the second, opposite, direction.

The sprocket hub 2054 can include a sprocket 2057 arranged on an outer diameter thereof, which can be coupled to a crank shaft of an internal combustion engine, for example, via a belt, chain, and/or gear train assembly. The cradle rotor 2052 may be attached to the cam shaft of the internal combustion engine via a cam bolt 2092. In general, the cradle rotor 2052 may be in engagement with the locking assemblies 2090.

In the illustrated non-limiting example, the input shaft 2080 may be coupled to the rotary actuator 2022, such that rotation of the rotary actuator 2022 rotates the input shaft 2080. As mentioned previously, the second sun gear 2208 is rotationally fixed to the rotary actuator 2022 and prevented from rotating. The rotary actuator 2022 is coupled to the first sun gear 2202 to control the rotation of the first sun gear. In general, the second ring gear 2206 may be rotationally coupled to the sprocket hub 2054, such that the second ring gear 2206 rotates with the sprocket hub 2054.

In operation, the rotary actuator 2022 may apply the torque to the first sun gear 2202 to achieve a known amount of rotary displacement of the first ring gear 2200. The amount of displacement of the first ring gear 2200 is based on the gear ratio of the planetary actuator 2001, which corresponds with a known desired rotational displacement of the spider rotor 2056. The rotary actuator 2022 can be controlled and powered by a controller (e.g., controller 24).

During operation, the sprocket hub 2054 can be coupled to the crank shaft of the internal combustion engine and the cam shaft of the internal combustion engine can be fastened to the cradle rotor 2052. Thus, the camshaft and the crankshaft can be coupled to rotate together, with the camshaft rotating half as fast as the crankshaft, via the mechanical cam phasing system 2010. When the engine is operating and no rotational/positional adjustment of the cam shaft is desired, the mechanical cam phasing system 2010 can be in a locked state to lock the rotational relationship between the camshaft and the crankshaft. In this locked state, the rotary actuator 2022 does not rotate the input shaft 2080 of the planetary actuator 2001. Thus, the first ring gear 2200 and the second ring gear 2206 each rotate in unison with the sprocket hub 2054. Therefore, the follow mechanism is not rotated relative to the sprocket hub 2054, which causes locking assemblies 2090 to lock relative rotation between the cradle rotor 2052 and the sprocket hub 2054. As a result, the rotational relationship between the camshaft and the crankshaft is maintained.

To advance or retard the camshaft relative to the crankshaft (i.e., adjust the phase angle of the camshaft), the rotary actuator 2022 provides a torque to the input shaft 2080 of the planetary actuator 2001. In one non-limiting example, the direction and magnitude of rotation of the input shaft 2080 can be correlated to a corresponding known rotation of the first ring gear 2200 relative to the second ring gear 2206. Since the second ring gear 2206 is rotationally coupled to the sprocket hub 2054, the first ring gear 2200 may be rotated relative to the sprocket hub 2054. Rotation applied to the first ring gear 2200 may generate corresponding magnitude and directional movement of the follow mechanism (e.g., bearing cage) via a coupling between the first ring gear and the follow mechanism. In one non-limiting example, the coupling is configured to maintain the force applied to the spider rotor 2056 until the cradle rotor 2052 reaches the desired rotational position relative to the sprocket hub 2054, which is determined by the rotary input displacement/force provided by the rotary actuator 2022 and the gear ratio of the planetary actuator 2001. In one non-limiting example, rotation of the spider rotor 2056 can engage the locking assemblies 2090 and place the cam phasing system 2010 into an actuation state.

In the actuation state, the cradle rotor 2052 rotates in the same rotational direction in which the spider rotor 2056 is rotated. For example, in the non-limiting example where the first ring gear 2200 rotates the spider rotor 2056 clockwise, the cradle rotor 2052 can also rotates clockwise. In general, in response to a given rotary input applied to the spider rotor 2056 via the planetary actuator 2001, the cradle rotor 2052 rotationally follows the spider rotor 2056. The cradle rotor 2052 follows the spider rotor 2056 until reaching a predetermined rotary position of the spider rotor 2056. The predetermined position of the spider rotor 2056 is determined by the controller based on the magnitude of rotation of the input shaft 2080 and the gear ratio of the planetary actuator 2001.

Rotation of the cradle rotor 2052 with respect to the sprocket hub 2054 can alters the rotational relationship between the camshaft and the crankshaft. The amount of rotation of the spider rotor 2056 for a given rotation of the rotary actuator 2022 is calculated based on the gear ratio between the first sun gear 2202 and the first ring gear 2200. In one example, the mechanical cam phasing system 2010 can enable the cradle rotor 2052 to only rotate in the same direction as the spider rotor 2056. Thus, during engine operation, the mechanical cam phasing system 2010 can alter the rotational relationship between the camshaft and the crankshaft.

In general, the design of the cam phasing system 2010 only requires rotation of the input shaft 2080 via the rotary actuator 2022 when rotation of the camshaft relative to the camshaft (e.g., to change a phase angle therebetween) is desired.

Figure 11:
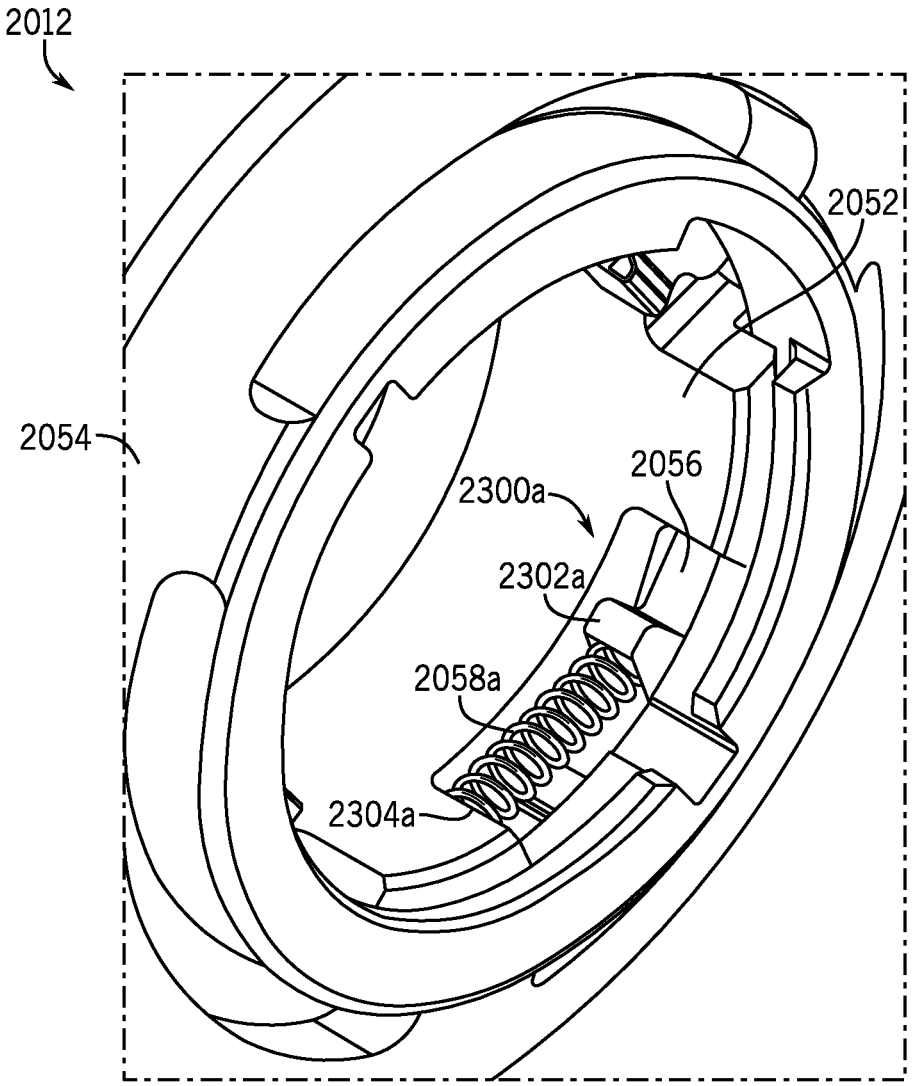
FIG. 11 is a perspective view the cam phasing system of FIG. 10 including a backlash compensation biasing element.
Figure 12:
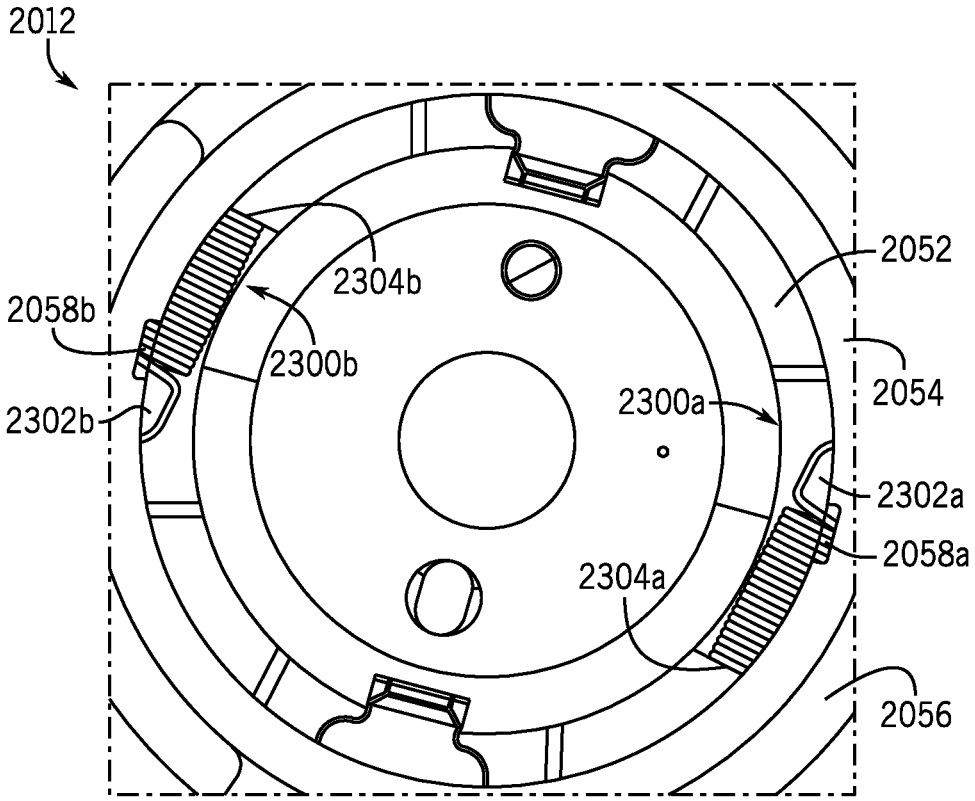
FIG. 12 is a top view of the backlash compensation biasing element of FIG. 11.

FIGS. 11 and 12 illustrate a non-limiting example of the cam phaser of FIG. 10 including a biasing element 2058 configured to compensate for backlash within a cam phasing system. The actuator 2022 can directly and/or indirectly engage the spider rotor 2056 of the cam phaser 2012 to accurately control a rotary position of the spider rotor 2056. As described above, the spider rotor is configured to cause corresponding movement of the cradle rotor 2052 spider rotor, which alters a rotational relationship between the cradle rotor 2052 and the sprocket hub 2054. As a result, the rotational relationship between the camshaft and the crankshaft is also altered.

In one example, the biasing element 2058 is a coil spring (e.g., a linear or a progressive spring). The biasing element 2058 can apply a constant biasing force between the spider rotor 2056 and the cradle rotor 2052, which biases the spider rotor and cradle rotor into contact with each other. In one non-limiting example, the relative rotational position between the spider rotor 2056 and the cradle rotor 2052 is substantially fixed, aside from minute rotations between the components during the locking and unlocking of the cam phaser 2012.

As illustrated in FIG. 11, the biasing element 2058 is arranged between the cradle rotor 2052 and the spider rotor 2056. The cradle rotor 2052 includes a first recess 2300*a* extending axially into the cradle rotor 2052. The spider rotor 2056 includes a radial protrusion 2302*a* extending radially inwards and received within the recess 2300*a*. The biasing element 2058*a* is arranged between an end 2304*a* of the recess and the radial protrusion 2302.

As illustrated in FIG. 12, the cam phaser 2012 can include more than one biasing element, for example, two biasing elements 2058, including a first biasing element 2058*a* and a second biasing element 2058*b*. In the illustrated non-limiting example, the second biasing element 2058*b* is arranged within a second recess 2300*b* that is circumferentially opposite to the first recess 2300*a* (e.g., the first and second recesses 2300*a*, 2300*b* are circumferentially separated by 180 degrees). Accordingly, the spider rotor 2056 includes a second radial protrusion 2302*b* circumferentially opposite to the first radial protrusion 2302*a*. The second radial protrusion extends radially inwards and is received within the second recess 2300*b*. The second biasing element 2058*b* is arranged between an end 2304*b* of the second recess 2300*b* and the second radial protrusion 2302*b*.

According to other non-limiting examples, the biasing element (e.g., biasing element 58') can be arranged between the sprocket hub 2054 and the spider rotor 2056. In this alternative configuration, the torque applied by the biasing element is proportional to a phase angle of the cam system. For example, as the phase angle increases or decreases, the applied biasing force increases or decreases as the relative rotational position between the sprocket hub 2054 and the spider rotor 2056 changes. According to some non-limiting examples, a plurality of biasing elements can be circumferentially arranged around the follower mechanism.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

We claim:

1. A method of controlling a cam phasing system for varying a rotational relationship between a crankshaft and a camshaft, the cam phasing system including a cam phaser having a sprocket hub driven by a crankshaft, a cradle rotor coupled to a camshaft, a spider rotor arranged between the cradle rotor and the sprocket hub, and an actuator configured to adjust a phase angle of the cradle rotor relative to the sprocket hub, the method comprising:

receiving a phase angle command to actuate the cam phaser from a first phaser position to a second phaser position, the first phaser position and the second phaser position corresponding to a first phase angle and a second phase angle, respectively;

determining a required actuator position of the actuator corresponding to the second phaser position;

commanding the actuator from a current actuator position to the required actuator position plus a predetermined amount of actuator overshoot, wherein the predetermined amount of actuator overshoot is configured to compensate for backlash within the cam phasing system.

2. The method of claim 1, wherein the predetermined amount of actuator overshoot corresponds to a predetermined magnitude of backlash within the cam phasing system.

3. The method of claim 1, wherein the cam phasing system further includes a biasing member coupled between the spider rotor and the cradle rotor, and wherein the biasing member is configured to bias the cradle rotor in a first rotational direction relative to the spider rotor.

4. The method of claim 3, further comprising:

determining whether the phase angle command requires actuation of the cradle rotor in the first rotational direction or an opposing second rotational direction; and commanding the actuator from the current actuator position to the required actuator position plus the predetermined amount of actuator overshoot upon determining that the phase angle command requires actuation of the cradle rotor in the first rotational direction.

5. The method of claim 4, wherein, upon determining that the phase angle command requires actuation of the cradle rotor in the second rotational direction, commanding the actuator from the current actuator position to the required actuator position without additional overshoot of the actuator.

6. The method of claim 4, further comprising:

determining whether an actuator positioning error between the current actuator position and the required actuator position is greater than a predetermined threshold; and commanding the actuator from the current actuator position to the required actuator position plus the predetermined amount of actuator overshoot upon determining that the actuator positioning error is greater than a predetermined threshold.

7. The method of claim 4, further comprising:

determining whether an actuator positioning error between the current actuator position and the required actuator position is greater than a predetermined threshold; and commanding the actuator from the current actuator position to the required actuator position without the predetermined amount of actuator overshoot upon determining that the actuator error is less than a predetermined threshold.

8. The method of claim 4, wherein the first rotational direction corresponds to retarding the camshaft relative to the crankshaft and the second rotational direction corresponds to advancing the camshaft relative to the crankshaft.

9. The method of claim 1, wherein determining the required actuator position and commanding the actuator is handled by a controller.

10. The method of claim 9, further comprising:

operating the actuator in response to a first portion of a command from the controller to move from the current actuator position to the required actuator position.

11. The method of claim 10, further comprising:

operating the actuator in response to a second portion of a command from the controller to move the actuator from the required actuator position a magnitude corresponding to an amount of backlash present within the cam phasing system.

12. A method of controlling a cam phasing system for varying a rotational relationship between a crankshaft and a camshaft, the cam phasing system including a cam phaser having a sprocket hub driven by a crankshaft, a cradle rotor coupled to a camshaft, a spider rotor arranged between the cradle rotor and the sprocket hub, and an actuator configured to adjust a phase angle of the cradle rotor relative to the sprocket hub, the method comprising:

actuating the actuator from a first position to a second position in response to a command from a controller; and, rotating a follower member from a first rotational position to a second rotational position in response to movement of the actuator, wherein a magnitude of actuation of the actuator corresponds to a magnitude of rotation of the follower member, wherein the follower member is biased in the first rotational direction relative to the cradle rotor, and wherein rotating the follower member in the first rotational direction includes rotating the follower member a first rotational distance between the first rotational position and the second rotational position, and a second rotational distance corresponding to an amount of backlash in the cam phasing system.

13. The method of claim 12, wherein rotating the follower member in the second rotational direction does not include the second rotational distance corresponding to backlash within the cam phasing system.

14. The method of claim 12, further comprising:

determining whether an actuator positioning error between a current actuator position and a required actuator position is greater than a predetermined threshold; and commanding the actuator from the current actuator position to the required actuator position plus the predetermined amount of actuator overshoot upon determining that the actuator positioning error is greater than the predetermined threshold.

15. The method of claim 12, further comprising:

determining whether an actuator positioning error between a current actuator position and a required actuator position is greater than a predetermined threshold; and commanding the actuator from the current actuator position to the required actuator position without the predetermined amount of actuator overshoot upon determining that the actuator positioning error is less than the predetermined threshold.

* * * * *